US009334595B2

(12) United States Patent
Archibeck

(10) Patent No.: US 9,334,595 B2
(45) Date of Patent: May 10, 2016

(54) TOOL FOR INSERTING OR REPLACING DRAWSTRINGS

(76) Inventor: Chad W. Archibeck, Hermosa Beach, CA (US)

( * ) Notice: Subject to any disclaimer, the term of this patent is extended or adjusted under 35 U.S.C. 154(b) by 683 days.

(21) Appl. No.: 13/275,241

(22) Filed: Oct. 17, 2011

(65) Prior Publication Data

US 2012/0090167 A1 Apr. 19, 2012

Related U.S. Application Data

(60) Provisional application No. 61/394,283, filed on Oct. 18, 2010.

(51) Int. Cl.
*A41H 43/00* (2006.01)
*D05B 91/02* (2006.01)

(52) U.S. Cl.
CPC . *D05B 91/02* (2013.01); *Y10T 29/53* (2015.01)

(58) Field of Classification Search
CPC ..... D05B 91/02
USPC ..... 223/50, 103; 66/116, 117, 120; 119/802–804; 43/87; 24/115 H
See application file for complete search history.

(56) References Cited

U.S. PATENT DOCUMENTS

| | | | | | |
|---|---|---|---|---|---|
| 535,108 | A | | 3/1895 | Helgesson | |
| 609,712 | A | | 8/1898 | Thompson | |
| 636,728 | A | * | 11/1899 | Kindel | 223/103 |
| 683,946 | A | | 10/1901 | Kops | |
| 1,119,659 | A | | 12/1914 | Steiner et al. | |
| 1,463,776 | A | * | 7/1923 | Knudtson | 119/804 |
| 1,891,815 | A | * | 12/1932 | Heidrich | 223/103 |
| 2,093,631 | A | * | 9/1937 | Burnham | 66/117 |
| 2,236,506 | A | | 4/1941 | Hirsch | |
| 2,242,880 | A | | 5/1941 | Dunn | |
| 2,491,776 | A | | 12/1949 | Skelton | |
| 2,763,410 | A | | 9/1956 | Walker | |
| 4,671,437 | A | | 6/1987 | Sauger | |
| 4,863,079 | A | | 9/1989 | Holmgren | |
| 4,950,015 | A | * | 8/1990 | Nejib et al. | 294/100 |
| 5,171,314 | A | * | 12/1992 | Dulebohn | 606/113 |
| 5,201,741 | A | * | 4/1993 | Dulebohn | 606/113 |
| 5,340,001 | A | | 8/1994 | Ard | |
| 5,417,230 | A | * | 5/1995 | Wood | 132/212 |
| 5,447,260 | A | | 9/1995 | Beddow | |
| 5,524,800 | A | * | 6/1996 | Arney | 223/50 |
| 5,621,952 | A | | 4/1997 | Frano | |
| 5,785,215 | A | | 7/1998 | Hinkel | |

(Continued)

FOREIGN PATENT DOCUMENTS

| | | | | |
|---|---|---|---|---|
| CA | 2080805 | | 4/1994 | |
| JP | 2001131851 | A * | 5/2001 | D04D 11/00 |

*Primary Examiner* — Nathan Durham
(74) *Attorney, Agent, or Firm* — Morrison & Foerster LLP

(57) ABSTRACT

A tool for inserting a drawstring into a drawstring passage has elongated leading and trailing bodies which are connected to each other by a flexible member. The trailing body defines at its rear end an aperture into which an end of a drawstring can be inserted, which drawstring can be secured to the trailing body by the cooperation with the trailing body of a drawstring retainer. The retainer is carried by the trailing body and is movable relative to that body toward and away from the rear end of that body. When the retainer is at its rear end limit of movement relative to the trailing body, the retainer is effective to cause a drawstring inserted into the aperture to be held in the insertion tool. The retainer can be spring-biased toward its rearward limit of motion in the insertion tool.

15 Claims, 9 Drawing Sheets

(56) References Cited

U.S. PATENT DOCUMENTS 5,979,106 A * 11/1999 Butler ..... 43/87
6,026,608 A 2/2000 Grimes
6,684,562 B1 * 2/2004 Schade ..... 43/87
2007/0250070 A1 * 10/2007 Nobis et al. ..... 606/113
2011/0101042 A1 * 5/2011 Ross et al. ..... 223/50
2011/0240690 A1 * 10/2011 Newsom et al. ..... 223/50

* cited by examiner

TOOL FOR INSERTING OR REPLACING DRAWSTRINGS

CROSS-REFERENCE TO RELATED APPLICATION

This application claims the benefit of U.S. provisional patent application No. 61/394,283 filed on Oct. 18, 2010.

FIELD OF THE INVENTION

This invention pertains to the placement of drawstrings into drawstring passages in garments and other flexible articles which are constructed to enable the use of drawstrings in them. More particularly, this invention pertains to a tool useful to inserting a drawstring into a drawstring passage in such an article.

BACKGROUND OF THE INVENTION

Many garments use drawstrings to enable the garments to be secured in place on the bodies of wearers of the garments. The drawstrings commonly are threaded through a passage defined by a hem of the garment. Opposite end portions of the drawstring are located outside the passage so that they can be manipulated by a wearer of the garment to form a bow knot, e.g., which secures the garment in known ways to the wearer's body. Drawstrings also are used as closures for storage bags of various things.

It often happens that a drawstring can be partially or fully withdrawn from its hem so that the drawstring cannot be used to perform its desired function. Partial withdrawal of a drawstring from its hem passage occurs when the drawstring is moved in the passage to cause one of the ends of the drawstring to be located within the passage; in such an event, that end of the drawstring is inaccessible. A solution to the problem of a partially withdrawn drawstring is to remove the drawstring from its passage in the hem and to rethread (reinsert) the drawstring into the passage so that the opposite end portions of the drawstring are again accessible outside the passage.

The solution to the problem of a fully withdrawn drawstring is to rethread (reinsert) the drawstring into the hem passage so the opposite end portions of the string are again accessible outside the passage.

Insertion of a drawstring into a hem passage of an existing article such as a garment can be a difficult and time consuming task. Many people cannot successfully perform that task, such as because they do not know how to do it or because they do not have a tool to use to perform that task.

Partial or complete withdrawal of a drawstring from a hem passage can occur in a number of ways. In the laundering of garments equipped with drawstrings, forces can be applied to drawstrings to cause them to move along their hem passages so that the drawstrings become partially or fully removed from their garments.

SUMMARY OF THE INVENTION

To address the problems described above, this invention provides simple, effective, and easily used tools for inserting a drawstring into a hem passage. Generally speaking, a preferred embodiment of a drawstring inserter tool according to this invention comprises an elongate leading body having forward and rear ends, an elongate flexible member connected at a front end thereof to the rear end of the leading body, and a trailing body connected at a front end thereof to the rear end of the flexible member. An aperture into which an end of a drawstring can be inserted, is defined at the rear end of the trailing body. A drawstring retainer member is carried by the trailing body and is movable relative to the trailing body toward and away from the rear end of the trailing body. The trailing body and the retainer member are cooperatively configured to secure a drawstring to the trailing body when a drawstring is disposed in the aperture and the retainer member is at a rearward limit of movement relative to the trailing body.

DESCRIPTION OF THE DRAWINGS

The above-mentioned and other features and aspects of the preferred embodiments according to this invention are more fully described below with reference to the accompanying drawings in which.

DESCRIPTION OF THE PREFERRED EMBODIMENTS OF THE INVENTION

Figure 1:
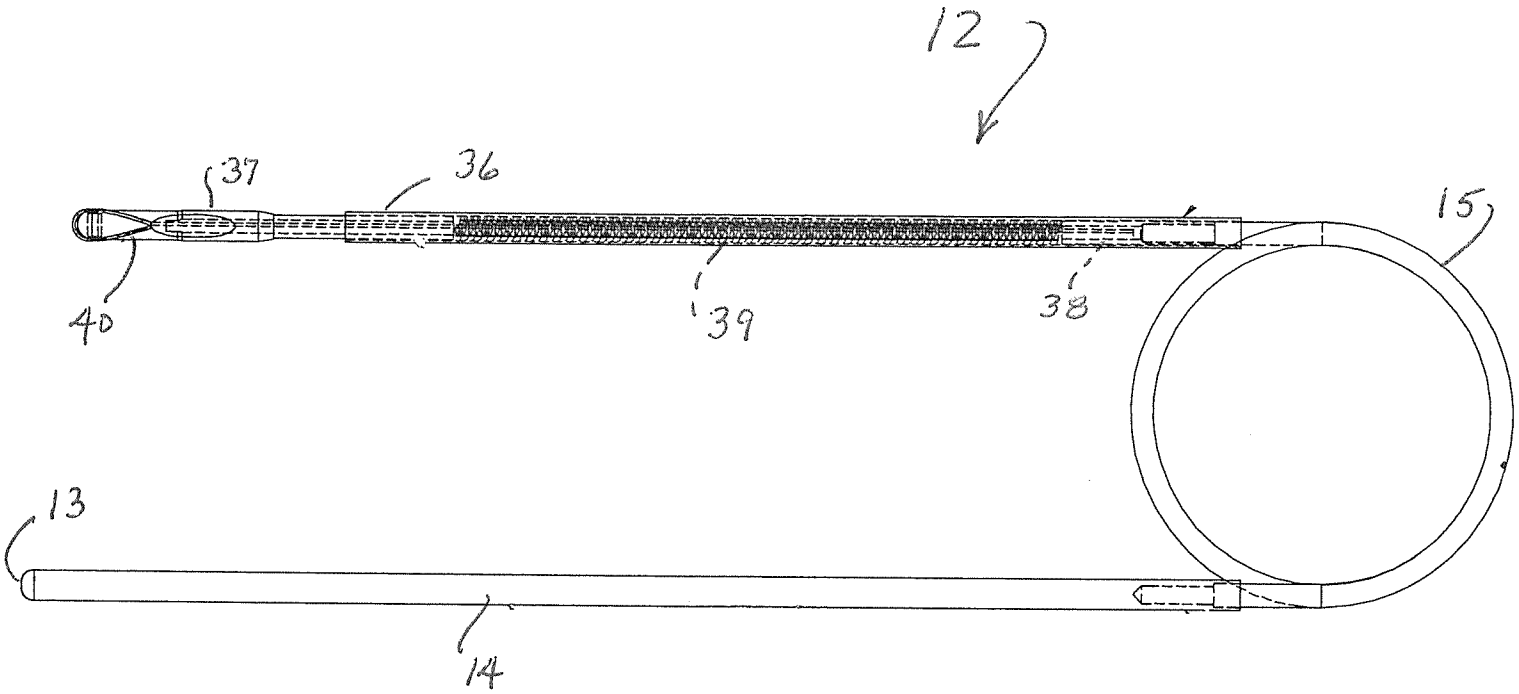
FIG. 1 is a plan view, with some internal structural features shown in broken lines, of a preferred embodiment according to this invention.
Figure 2:
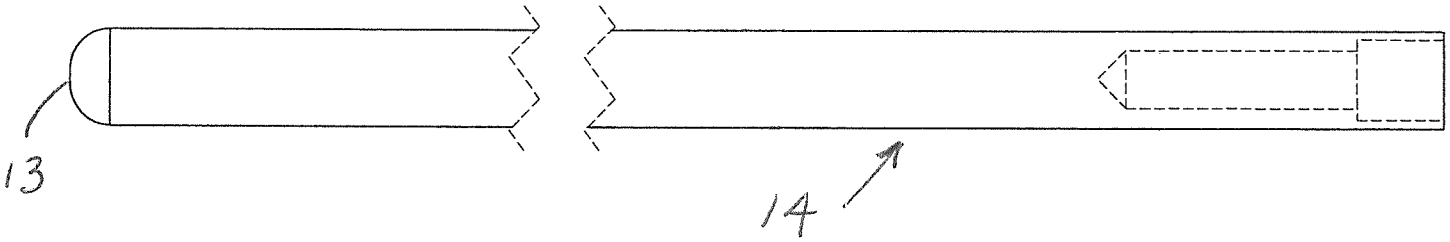
FIG. 2 is a plan view of a leading body of the preferred embodiment shown in FIG. 1.

Two preferred embodiments of drawstring inserters according to this invention are depicted in the accompanying drawings. A first inserter 10 is shown in part in FIGS. 9-13. A second inserter 12 is shown complete in FIG. 1, with components of that inserter being shown in FIGS. 2-8. FIGS. 9-13 illustrate the aspects of inserter 10 which differ from inserter 12; those aspects relate to the trailing body assembly of inserter 10 as compared to the trailing body assembly of inserter 12. Inserter 12 is described first below, from which the difference between inserter 10 and 12 will be apparent. Inserter 12 is well suited for use in inserting drawstrings of any size into garment passages which have cross-sectional areas ranging from small to large.

Inserters 10 and 12 each have a leading end 13 and an opposite trailing end; the structures of the trailing end body assemblies of inserters 10 and 12, while different, have the common property of being operable to hold to the trailing end of the inserter a lead end of a drawstring which is to be inserted, by use of the inserter, into and through a drawstring passage to place the opposite end portions of the drawstring outside the opposite ends of the passage. Inserters 10 and 12 have other aspects of their structure in common; each inserter has an elongated, stiff comparatively small diameter leading (head end) body 14 having a smoothly rounded front end. Inserters 10 and 12 also include a length of flexible cable 15 or cord which is secured to the rear end of the head end body 14 and which extends rearwardly along the length of the inserter to its opposite end which is secured to the front end of the drawstring-holder structure (trailing body) at the trailing end of the inserter.

A presently preferred inserter head end body 14 is about 0.165 inch in diameter and about 6.8 inches long, and can be made of aluminum or steel with an axial bore at its rear end into which an end of cable 15 can be inserted. See FIG. 2. The cable can be secured to the head end body 14 by crimping the bore walls tight to the cable end.

A preferred cable is a braided wire cable which has been smoothly coated with a soft synthetic resin material to enable the cable to be slid easily along a garment drawstring passage without snagging or catching on the garment fabric.

Figure 3:
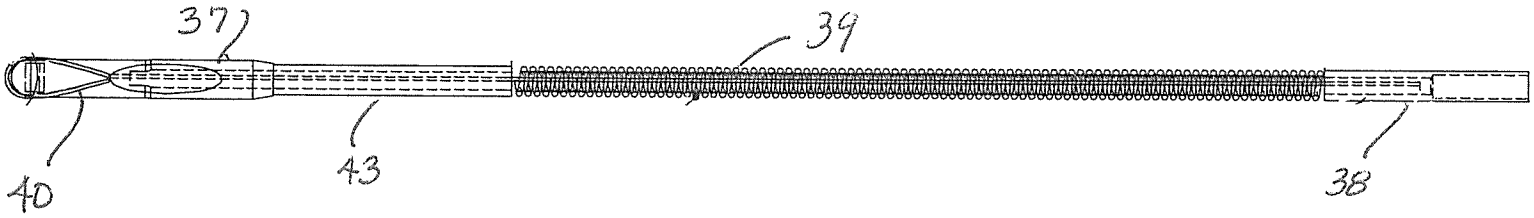
FIG. 3 is a plan view of some of the components of a trailing body assembly of the preferred embodiment shown in FIG. 1.
Figure 4:
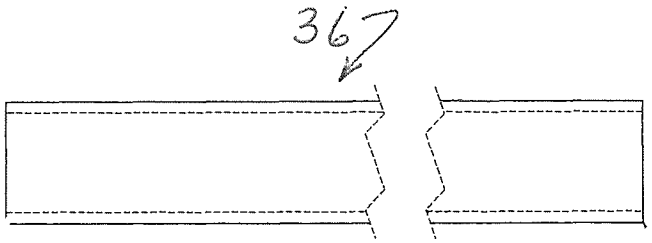
FIG. 4 is a plan view of a cover tube component of the trailing body assembly shown in FIG. 3.

Components of a trailing body drawstring-holder assembly 35 of inserter 12 are depicted in FIGS. 3-8 in which FIG. 3 depicts a subassembly. FIG. 1 shows the fully assembled inserter 12. Inserter 12's trailing end structure preferably includes an elongate rigid body tube 36 (FIG. 4), a snare or retainer member 37 (FIGS. 5-7), a crimp adaptor 38 (FIG. 8), a coiled compression spring 39 (FIG. 3), and a snare wire loop 40 (FIG. 3). The body tube can be about 5 inches long with an outer diameter of about 0.165 inch and an inner diameter of about 0.135 inch. The retainer member can be about 2 inches in overall length, and be generally of round rod-like nature with an outer diameter the same as that of the body tube. The crimp adaptor 38 can be of tubular nature about 0.85 inch long with larger and smaller inner diameters; the larger adaptor bore diameter can be about 0.125 inch and its bore smaller diameter can be about 0.068 inch; the larger and smaller diameter bores in the crimp adaptor can be of about equal length.

Figure 5:
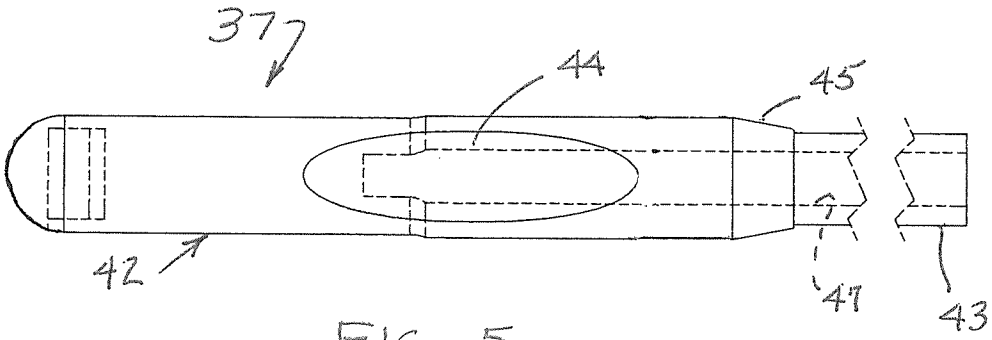
FIG. 5 is a plan view of the drawstring retainer member of the assembly shown in FIG. 3.
Figure 6:
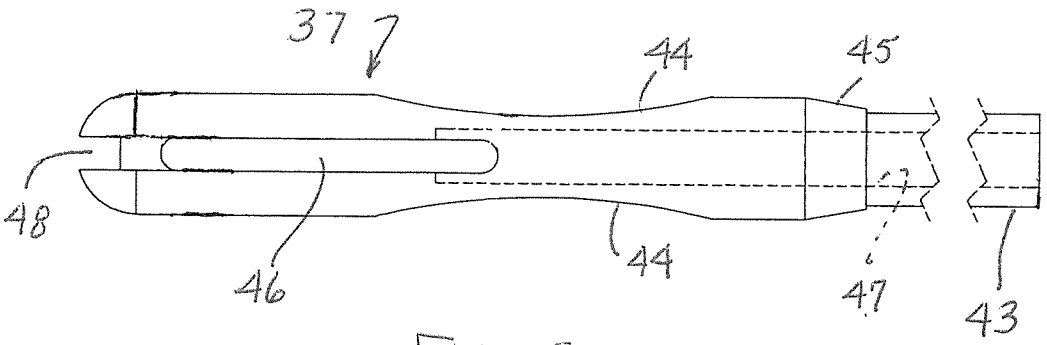
FIG. 6 is an elevation view of the retainer member shown in FIG. 5.
Figure 7:
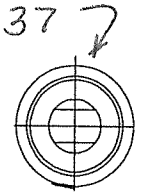
FIG. 7 is a rear end view of the retainer member shown in FIG. 5.
Figure 8:
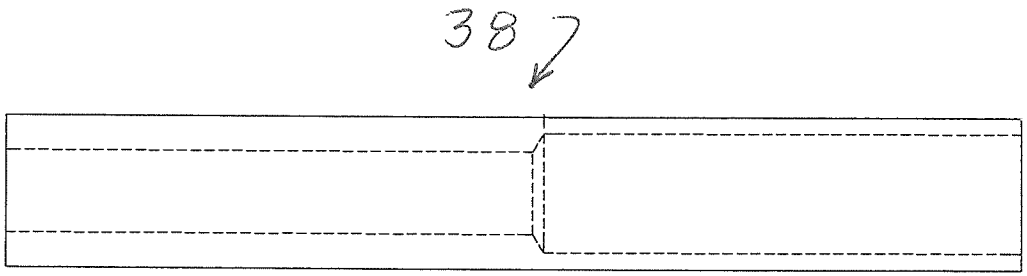
FIG. 8 is a plan view of a crimp adaptor component of the assembly shown in FIG. 3.

FIG. 5 is a top plan view of retainer member 37, and FIGS. 6 and 7 are side elevation and end views of that retainer. As noted above, retainer 37 can be about 2 inches long and be comprised by a body 42 and a reduced diameter coaxial stem 43 which can be (preferably is) of tubular nature with an outer diameter sized to fit loosely and slidably in body tube 36; see FIG. 1. The body 42 of the retainer can be about 1 inch long and the stem of that housing can be about 1 inch long. Concave finger recesses 44 (or other features which make it easy for a user to securely hold the retainer between two fingers of one hand) can be formed in the top and bottom portions of snare housing body 42 as shown in FIGS. 5 and 6. A wire exit passage 46 is formed through the retainer body from side to side of the body as shown in FIG. 6; the passage has a length of about one-half inch along the body and has a height (FIG. 16) which provides clearance for the diameter of snare wire 40. A coaxial bore 47 extends along the stem of the retainer into communication with the adjacent end of wire exit passage 46 and provides clearance for two parallel lengths of the snare wire. A groove 48 extends across the end of the retainer opposite from stem 43 and around the adjacent sides of the retainer; the groove has a height equal to that of the wire exit passage and communicates at its ends with the adjacent end of that passage.

Snare wire 40 can be defined by a length of nicinol wire about 12 inches in length. Nitinol is a shape memory metal alloy. (Wire loop 22 of inserter 10 can be defined by nicinol wire.) The snare wire length preferably is bent at its middle so that its ends become parallel and those ends of the snare wire can be inserted into the opposite openings of wire exit passage 46 in retainer 37 and then down and out of the axial bore of the retainer. The snare wire ends preferably are passed down the center of the coil compression spring 39 and into the small diameter bore of crimp adaptor 38 as the spring is compressed between the retainer 37 and the crimp adaptor. While the return bend of the snare wire is seated in end groove 48 of the retainer and the ends of the snare wire are in their proper position in the crimp adaptor, the crimp adaptor can be crimped to secure the snare wire ends within it. The subassembly so created is then inserted into body tube 36 so that the body tube is spaced a short distance (about 0.4 inch) from the shoulder 45 between the body and the stem of the retainer after the end of cable 15 has been placed into the large bore of the crimp adaptor, and then the body tube end can be crimped down onto the large bore end of the crimp adaptor to secure the body tube, the crimp adaptor and the cable together.

The drawstring retainer 37 can be retracted from the snare wire bend against the bias of the compression spring 39; such retraction is possible because of the gap between the body tube 36 and the retainer shoulder 45. When the snare wire bend is exposed, an end of a drawstring can be threaded into the loop or aperture formed by the wire. The drawstring is held to the inserter by the spring-generated force between the wire and the retainer when the retainer is released. That is, the inserter trailing body and the retainer 37 are cooperatively configured to secure a drawstring to the trailing body when a drawstring is disposed in the snare wire aperture and the retainer member is at its rearward limit of monument relative to the trailing body of the inserter. The inserter then can be used as described below with reference to inserter 10 to insert the drawstring into and through a drawstring passage.

Figure 9:
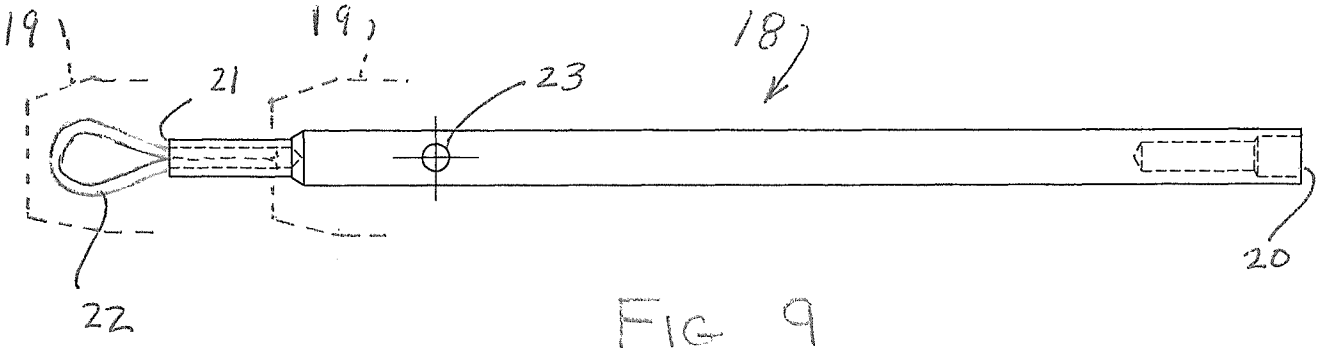
FIG. 9 is a plan view of the body of a trailing member assembly for an alternate preferred embodiment according to this invention.
Figure 10:
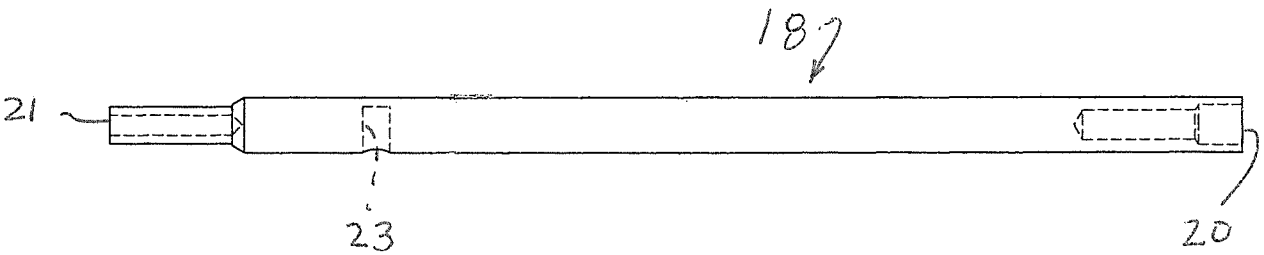
FIG. 10 is an elevation view of the assembly shown in FIG. 9.

The trailing end drawstring-holding structure 17 of inserter 10 includes an elongate comparatively small diameter rigid slider shaft 18 (FIGS. 9 and 10), and a retainer number 19 (FIGS. 11-13) which is captive to the slider shaft and is movable to limited extents along and preferably around the slider shaft. The slider shaft can be viewed as a trailing body in inverter 10. The slider shaft 18 can have a diameter of about 0.188 inch and a length of about 4 inches. The leading end 20 of the slider shaft can be axially bored to define a socket into which the trailing end of cable 15 can be crimped to secure the slider shaft coaxially to the cable. The trailing end 21 of the slider shaft can be axially bored to define a socket into which the opposite ends of a length of resilient wire can be secured by crimping the socket tight to the wire length ends. A wire so secured to the slider shaft forms a deformable wire loop 22 defining at the trailing end of the inserter, as shown in FIG. 9, an aperture into which can be inserted on end of drawstring. A radially opening hole 23 can be formed in the slider shaft to securely receive a pin for holding the retainer 19 captive to the slider shaft as described below.

Figure 11:
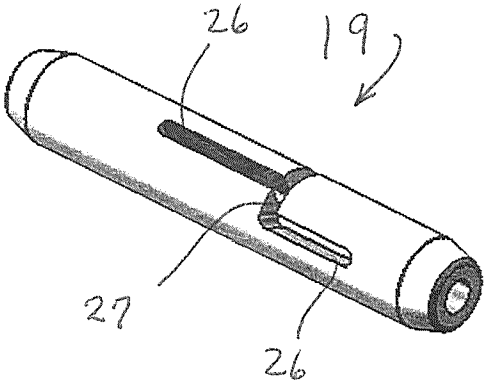
FIG. 11 is a perspective view of the retainer member cooperable with the trailing body shown in FIGS. 9 and 10.
Figure 12:
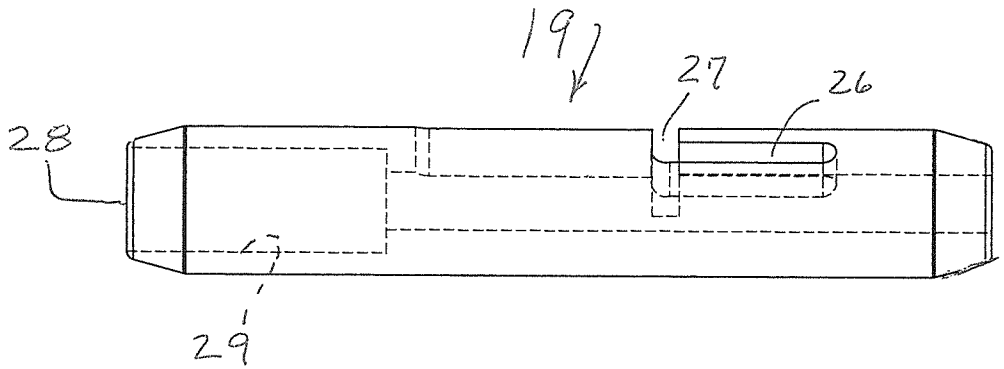
FIG. 12 is an elevation view of the retainer member shown in FIG. 11.
Figure 13:
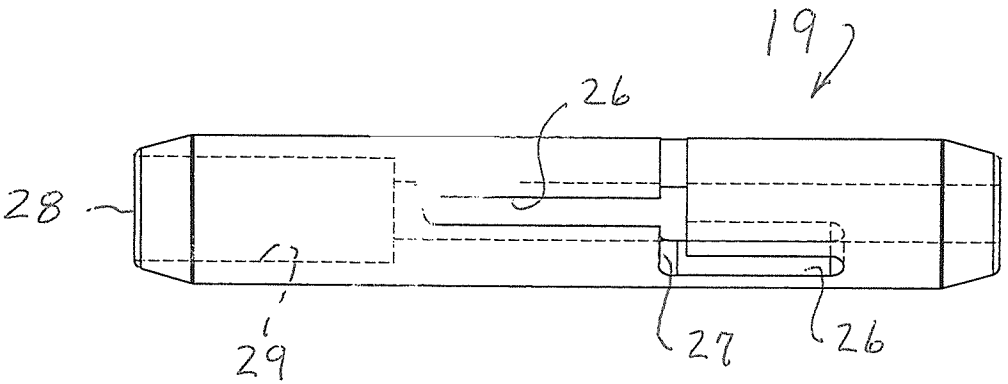
FIG. 13 is a plan view of the retainer members shown in FIG. 11.

As shown in FIGS. 11-13, retainer 19 can be defined to have a tubular nature with its opposite ends circumferentially chamfered, rounded or faired so that the retainer can be moved readily along the inside of a drawstring passage. The axial bore along retainer 19 has clearance about the slider shaft which extends into that bore. As shown, a slot 26 is formed through retainer 19 from its axial bore to the exterior surface of the retainer; the slot extends along the retainer between opposite ends of the slot which are located between the opposite ends of the retainer. A pin, secured to slider shaft 18 at hole 23, preferably is disposed in slot 26 outside the slider shaft and has its outer end located inside the outer surface of the retainer. There is clearance between the pin and the walls of slot 26 so that the retainer can have limited movement along the slider shaft. Preferably, slot 26 has a lateral offset or jog 27 between its ends so that the retainer can be turned about the slider shaft when the retainer is at about the middle of its range of motion along the slide shaft. The retainer has a trailing end 28 at and adjacent to which the bore of the slider body has an extent of increased diameter 29 as shown, e.g., in FIG. 13.

The placement of the pin on slider shaft 18 is defined in cooperation with the geometry of slot 26 so that inserter 10 can be operated in the manner shown in FIGS. 5, 12 and 13 to insert a drawstring into a drawstring passage of a garment, e.g. Retainer 19 can be moved axially on slider shaft 18 so that wire loop 22 is exposed at the trailing end of the inserter; see the right-hand phantom line representation of retainer 19 in FIG. 9. An end of a drawstring can be inserted through the aperture formed by wire loop 22. The retainer 19 then can be moved rearwardly along the slider shaft to, in effect, draw the wire loop and the drawstring end into the slider body's bore where the drawstring end can wedge or jam in the bore; see the left-hand phantom line representation of retainer 19 in FIG. 9. The leading end 13 of the inserter 10 then can be moved into an entrance opening of a drawstring hem passage and slid along the passage. The hem can be gathered on the inserter head end body toward the rear end of that body as needed. From time to time, the leading end of the inserter can be held in place in the hem and the fabric gathered on the inserter to the rear of the held location can be pulled along the inserter. The rear end of the head end body can then be grasped in the hem so that more of the hem can be gathered on the head end body to advance its leading end along the passage and ultimately out the other end of the passage. The hem can then be held as the inserter is pulled out of the passage, pulling the end of the drawstring with it. Insertion of the drawstring into its passage, with opposite ends of the drawstring outside the passage, will have been accomplished easily and quickly.

The dimensions and relations stated above concerning certain of the components of embodiments 10 and 12 are not critical, as it should be understood that the two embodiments disclosed are exemplary embodiments according to this invention. Inserters of other sizes are within the scope of the invention. It should also be noted that flexibility of an inserter is preferred, though not required, so that the inserter can be used to insert a drawstring into a passage around, for example, the waist of a pair of pants or trunks or around the perimeter of a hood of a garment such as a hooded sweatshirt or the like.

What is claimed is:

1. An inserter for inserting or replacing a string within a string passage of a garment, the inserter comprising:

a first body having a front end and a rear end, the first body having at the rear end thereof a boundary part forming an aperture, the aperture formed by a length of wire as the boundary part, the length of wire having opposite ends secured to the first body; and a retainer member movable relative to the first body toward and away from the rear end of the first body, the retainer member biased to move in the aperture toward a limit of movement relative to the first body, the first body and the retainer member having the property of being cooperatively configured to secure a string to the first body when the string is disposed in the aperture and held between the biased retainer member and the boundary part, the string held as the first body enters into, passes through, and exits out of the string passage of the garment, the front end of the first body leading the rear end of the first body.

2. An inserter according to claim 1 in which the retainer member is configured to engage a rear portion of the boundary part of the first body at the limit of movement of the retainer member.

3. An inserter according to claim 1, the inserter comprising:

a spring, the retainer member biased by the spring.

4. An inserter according to claim 1 in which portions of the length of wire extend through the retainer member.

5. An inserter according to claim 1 in which the length of wire comprises a shape memory metal alloy.

6. An inserter according to claim 1, the inserter comprising:

an elongate second body having opposite front and rear ends; and an elongate flexible member connected at a rear end thereof to the front end of the first body, the flexible member connected at a front end thereof to the rear end of the second body.

7. An inserter according to claim 1 in which a portion of the retainer member is carried within a portion of the first body.

8. An inserter for inserting or replacing a string within a string passage of a garment, the inserter comprising:

a first body having a front end and a rear end, the first body having at the rear end thereof a boundary part forming an aperture, the boundary part having a string engagement portion, the aperture formed by a length of wire as the boundary part, the length of wire having opposite ends secured to the first body; and a retainer member movable relative to the first body toward and away from the rear end of the first body, the retainer member movable to move in the aperture toward the string engagement portion, the first body and the retainer member having the property of being cooperatively configured to secure a string to the first body when the string is disposed in the aperture and held between the retainer member and the string engagement portion, the string held as the first body enters into, passes through, and exits out of the string passage of the garment, the front end of the first body leading the rear end of the first body.

9. An inserter according to claim 8 in which the retainer member is configured to engage the string engagement portion of the boundary part.

10. An inserter according to claim 8 in which the retainer member is biased to move in the aperture toward the string engagement portion of the boundary part.

11. An inserter according to claim 10, the inserter comprising:

a spring, the retainer member biased by the spring.

12. An inserter according to claim 8 in which portions of the length of wire extend through the retainer member.

13. An inserter according to claim 8 in which the length of wire comprises a shape memory metal alloy.

14. An inserter according to claim 8, the inserter comprising:

an elongate second body having opposite front and rear ends; and an elongate flexible member connected at a rear end thereof to the front end of the first body, the flexible member connected at a front end thereof to the rear end of the second body.

15. An inserter according to claim 8 in which a portion of the retainer member is carried within a portion of the first body.

* * * * *